US006367622B1

(12) United States Patent
Hsu

(10) Patent No.: US 6,367,622 B1
(45) Date of Patent: Apr. 9, 2002

(54) CONTAINER WITH SEPARATE STORAGE SPACES

(76) Inventor: Lily Hsu, 5Fl., No. 8, Alley 5, Lane 217, Sec. 3, Chunghsiao East Road, Taipei (TW)

( * ) Notice: Subject to any disclaimer, the term of this patent is extended or adjusted under 35 U.S.C. 154(b) by 0 days.

(21) Appl. No.: 09/875,898

(22) Filed: Jun. 8, 2001

(51) Int. Cl.[7] ..... B65D 25/08
(52) U.S. Cl. ..... 206/222
(58) Field of Search ..... 260/222; 220/505

(56) References Cited

U.S. PATENT DOCUMENTS 3,156,369 A * 11/1964 Bowes et al. ..... 206/222
3,220,588 A * 11/1965 Lipari ..... 206/222
3,548,562 A * 12/1970 Schwartzman ..... 206/222
3,603,469 A * 9/1971 Magni ..... 206/222
3,968,872 A * 7/1976 Cavazza ..... 206/222
3,970,068 A * 7/1976 Sato ..... 206/222
4,195,731 A * 4/1980 Cavazza ..... 206/222

* cited by examiner

*Primary Examiner*—Joseph M. Moy
(74) *Attorney, Agent, or Firm*—Shoemaker and Mattare

(57) ABSTRACT

A container with separate storage spaces includes a body for retaining a first substance therein and a sealing structure securely attached to the body for hermetically sealing the first substance in the body. The sealing structure has a sealing package hermetically enclosing a second substance, whereby the second substance can be released from the sealing package to be mixed with the first substance by cutting open the sealing package with a cutting member slidably cooperative with the sealing structure. With the use of the sealing structure, the container of this invention allows a person to refill the first substance to the body and replace a cut-open sealing package with a new one on his own, without need of manufacturer equipments.

15 Claims, 5 Drawing Sheets

CONTAINER WITH SEPARATE STORAGE SPACES

FIELD OF THE INVENTION

This invention relates to containers, and more particularly, to a container capable of separately receiving different substances.

BACKGROUND OF THE INVENTION

Conventionally when drinking a beverage wherein the formula and the liquid solution can be mixed only when it is ready to be consumed, a person generally has to separately open up the packages receiving the formula and the liquid solution, and then add the formula to the liquid solution to make it readily drinkable. This generates drawbacks of laborious operation and over-packaging.

In addition, the formula is generally received and sealed in the storage space of the container without being re-packaged, whereby the formula tends to be contaminated if the storage space for receiving the formula is not in condition sufficient to keep the formula from contamination. Therefore, additional effort is required for cleaning the container to a certain degree, thereby causing the cost for manufacturing the container to increase.

SUMMARY OF THE INVENTION

The primary objective of the present invention is to provide a container with separate storage spaces for receiving a first substance and a second substance that is to be mixed with the first substance, that simply requires "push-down" and "pull-up" operations for mixing the first substance and the second substance to make the mixture ready to be in consumed condition, and that allows the separation of the first substance from the second substance conveniently to be achieved without the use of a conventional sealing member. The container of this invention can also effectively prevent the first or second substance from contamination, when received in the container.

In accordance with the aforementioned and other objectives of the present invention, a container with separate storage spaces is provided. The container includes:

- a body defining a storage space for receiving a first substance therein and formed with an opening connecting the storage space;
- an outer engagement member adapted to be coupled to the body via the opening and formed with a through hole for connecting the opening of the body;
- an inner engagement member for being axially engaged with the outer engagement member, so as to allow a sealing package hermetically enclosing a second substance to be securely interposed between the outer engagement member and the inner engagement member in a manner that the storage space of the body is hermetically sealed by the sealing package, the inner engagement member being formed with a through hole of the outer engaging member; a cutting member movably sleeved with the inner engagement member for cutting the sealing package interposed between the outer and inner engagement members, so as to release the second substance from the sealing package; and a lid member attached to the body for covering the cutting member, the inner engagement member and the outer engagement member therein, the lid member being formed with a retaining hole for slidably retaining an actuating member adapted for being coupled with the cutting member, whereby the actuating member is allowed to push by an external force exerted thereon the cutting member toward the sealing package from a first position to a second position where the sealing package is cut open by the cutting member to release the second substance for being mixed with the first substance via the opening of the body.

Besides, the first substance in the body and the second substance in the sealing package are not necessarily limited to be in a solid, liquid or gaseous state. In other words, they may be a combination of, for example, liquid solution and formula, two gases that have to be mixed and reacted, or two liquids that can be mixed and reacted.

The features and functions of the present invention will be hereby below explained in further detail with the employment of preferred embodiments and attached Figures. It is to be understood that the attached Figures are only for the purpose of illustration in the following description and are not deemed to limit the scope of the present invention.

DETAILED DESCRIPTION OF THE PREFERRED EMBODIMENTS

Figure 1:
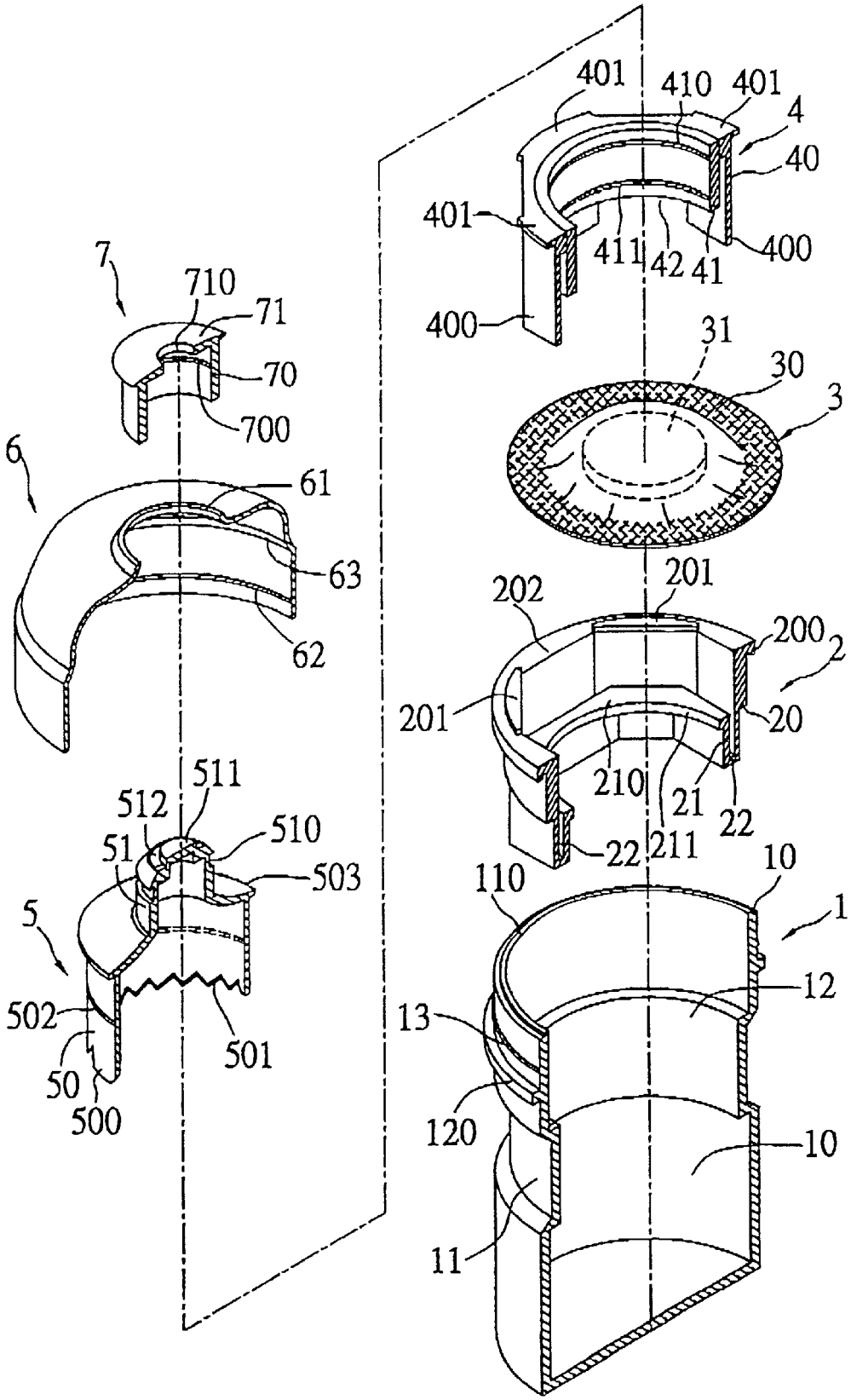
FIG. 1 is a sectional exploded perspective view of the container with separate storage spaces in a preferred embodiment of the present invention.
Figure 2:
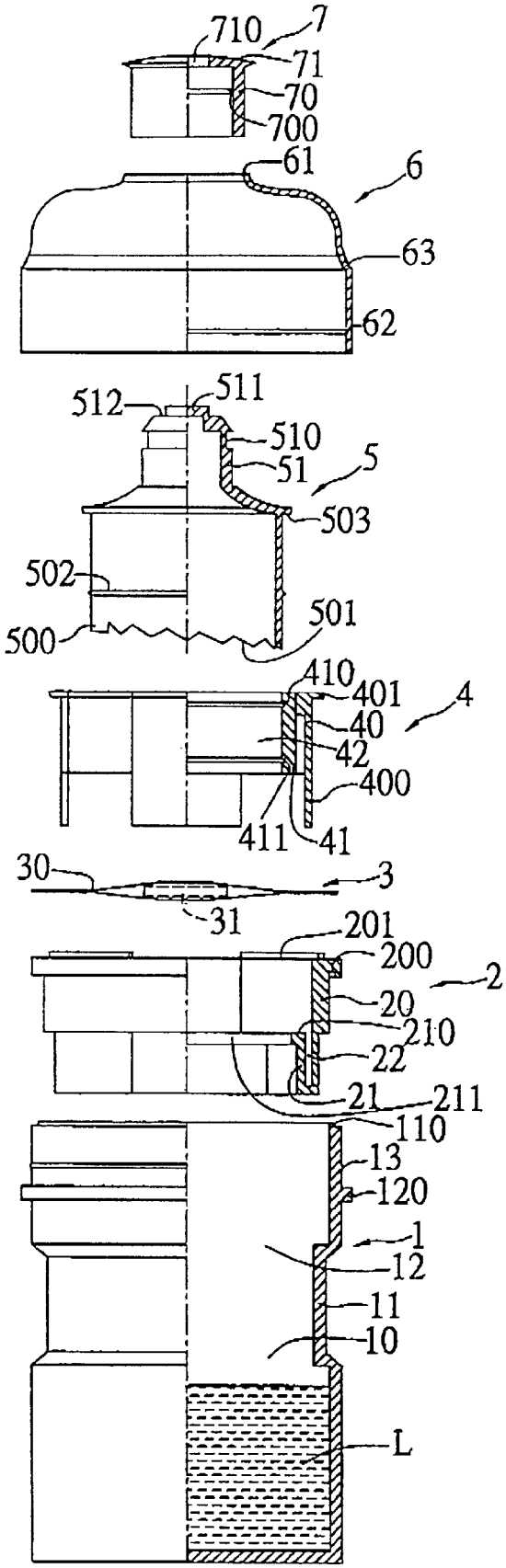
FIG. 2 is a partially sectional, exploded front view of the container with separate storage spaces in the preferred embodiment of the present invention.

As shown in FIGS. 1 and 2, the container with separate storage spaces of the present invention primarily consists of a body 1, an outer engagement member 2 for being mounted in the body 1, an inner engagement member 4 securely engaged with the outer engagement member 2 so as to allow a sealing package 3 hermetically enclosing a second substance 3 therein to be interposed between the outer engagement member 2 and the inner engagement member 4, a cutting member 5 slidably sleeved with the inner engagement member 4, a lid 6 attached to the body 1 for covering the outer engagement member 2, the inner engagement member 4 and the cutting member 5, and an actuating member 7 slidably retained with the lid 6.

The body 1 includes a storage space 10 defined by a body wall 11 of the body 1 for receiving a liquid solution L. An opening 12 is formed in the body 1 for connecting the storage space 10. The body 1 is further formed with a rim 110 on the top of the body wall 11 and flange 120 surrounding the outer surface of the body wall 11. An annular protrusion 13 is also protruded from the outer surface of the body wall 11 above the flange 120.

The outer engagement member 2 consists of an outer annular body 20 and an inner annular body 21 having their bottom ends connected to each other and their inner surface octagonally shaped. The height of the inner annular body 21 is smaller than that of the outer annular body 20. An engaging trough 22 is formed between the bottom of the outer annular body 20 and the inner annular body 21. On the top of the outer annular body 20 there are formed with a plurality of coupling protrusions 201 that protrude upwardly. And a shoulder 200 outwardly projected for engagement with the rim 110 of the body 1. A holding portion 210 defining a through hole 211 for connecting the opening 12 of the body 1 is integrally formed on and inwardly extended from the top of the inner annular body 201.

The inner engagement member 4 has an octagonal outer annular body 40 and a circular inner annular body 41 that are coaxially and integrally formed with each other. At the bottom of the outer annular body 40 there are formed with a plurality of extending portions 400 that can snugly engage with the engaging trough 22 of the outer engagement member 2. At the top of the inner engagement member 4 there are outwardly projected a plurality of coupling flanges 401 that each can be snugly fit into a corresponding one of a plurality of breaches 202 formed between any two coupling protrusions 201 on the outer engagement member 2. Thus, by this arrangement, the inner engagement member 4 can be securely engaged with the outer engagement member 2. At the upper part and lower part of the inner surface of the inner annular body 41, a first positioning annular groove 410 and a second positioning annular groove 411 are respectively formed. Meanwhile, when the inner engagement member 4 is engaged with the outer engagement member 2, the bottom part (not shown) of the inner annular body 41 of the inner engagement member 4 is to abut against the holding portion 210 of the outer engagement member 2. In addition, a through hole 42 is formed in the inner engagement member 4.

The sealing package 3 has a top sheet and a bottom sheet circumferentially sealed with the top sheet for hermetically enclosing a formula 31 therein. The top and bottom sheets are preferably made from aluminum sheet. The sealing package 3 is first placed on the holding portion 210. When the inner engagement member 4 is engaged in position with the outer engagement member 2, the peripheral edges of the sealing package 3 is securely interposed between the inner engagement member 4 and the outer engagement member 2, allowing the through holes 42, 211 of the inner engagement member 4 and the outer engagement member 2 to be sealed. Thus, the inner engagement member 4 and the outer engagement member 2, together with the sealing member 3 are formed into a structure capable of hermetically sealing the opening 12 of the body 1, thereby preventing the liquid solution L from escaping from the storage space 10 via the opening 12 of the body 1.

The cutting member 5 has an annular body 50 and a neck 51 integrally formed above the annular body 50, with the outer diameter of the annular body 50 smaller than the inner diameter of the inner annular body 41 of the inner engagement member 4. At the bottom of the cutting member 5 there are formed with a cutting end having an active portion 501 and an inactive portion 500. The active portion 501 is formed with a plurality of continuously saw-like teeth for cutting open the sealing package 3 and the inactive portion 500 is flat in surface for preventing the sealing package 3 from being completely cut off by the active portion 501. In addition, an annular protrusion 502 is protruded from the outer surface of the annular body 50 for being engaged with the first positioning annular groove 410 or the second positioning annular groove 411 of the inner annular body 41. On the outer surface of the neck 51 there are formed with an annular groove 510, and on the top of the neck 51 there are integrally formed with a round protrusion 511 and at least a outlet holes 512 surrounding the round protrusion 511.

The lid 6 is formed by an approximately hemispherical body that is attached to the body 1, so as to cover the outer engagement member 2, the sealing package 3, the inner engagement member 4, and the cutting member 5. At the top of the lid 6 there is formed with a retaining hole 61 for the neck 51 of the cutting member 5 to protrude and reach out therefrom. On the inner surface of the lower part of the lid 6 an annular groove 62 which can engage with the annular protrusion 13 on the body wall 11 of the body 1, is formed. At approximately the central portion of the lid 6 a stopper portion 63 is formed for abutting against the coupling protrusions 201 of the outer engagement member 2 and the peripheral edges of the coupling flanges 401 of the inner engagement member 4. Thus, when the lid 6 is attached to the body 1, the lid 6 can be securely held in place to the body 1.

The actuating member 7 is in a cap shape for being slidably retained in the retaining hole 61 of the lid 6 in a manner that the actuating member 7 is allowed to be detachably coupled to the cutting member 6. The actuating member 7 is formed with an annular body 70 and an integrally formed cover portion 71 that has a passage 710 at its center with which the round protrusion 511 at the top of the cutting member 5 can be air-tightly engaged. The cover portion 71 is adapted to air-tight cover the retaining hole 61 of the lid 6 at the time the round protrusion 511 is engaged with the passage 710. On the inner wall of the annular body 70 there is formed with an annular protrusion 700 that can engage with the annular groove 510 on the neck 51 of the cutting member 5.

Figure 3:
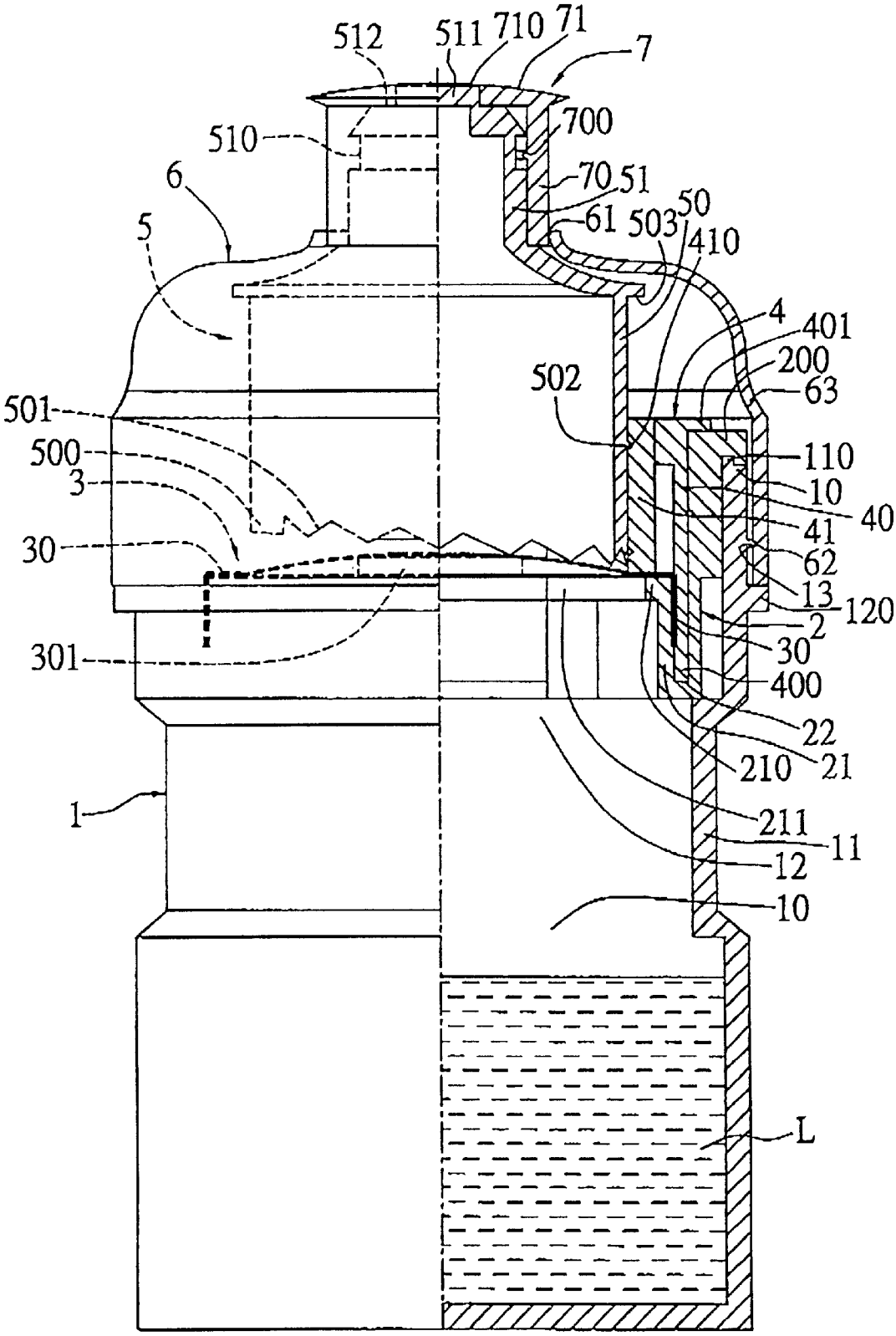
FIG. 3 is a partially sectional view of the container with separate storage spaces in the preferred embodiment of the present invention.

As shown in FIG. 3, the storage space 10 of the body 1 retains a liquid solution L. In assembly, the outer engagement member 2 is first coupled to the body 1 with its shoulder 200 engaged with the rim 13. Then the sealing package 3 is placed on the holding portion 210 of the outer engagement member 2, followed by engaging the inner engagement member 4 with the outer engagement member 2. At this point the extending portions 400 are inserted together with the peripheral edges of the sealing package 3 into the corresponding engaging trough 22. In the meantime the bottom of the inner annular body 41 of the inner engagement member 4 holds the peripheral portion 30 of the sealing package 3 in position on the holding portion 210, allowing the outer engagement member 2 and the inner engagement member 4 securely engaged the outer engagement member 2, together with the sealing package 3 to form a sealing structure capable of hermetically sealing the opening 12 of the body 1. The annular body 50 of the cutting member 5 is slidably sleeved in the inner annular body 41 of the inner engagement member 4, with the annular protrusion 502 on the cutting member 5 in cooperation with the first positioning annular groove 410 on the inner wall of the inner annular body 41 of the inner engagement member 4, so that the cutting member 5 is held in position. Then the lid 6 mounted with the actuating member 7 is attached to the body 1 and the neck 51 of the cutting member 5 is accordingly protruded out of the retaining hole 61 of the lid 6 for being received within the actuating member 7 slidably retained in the retaining hole 61. Meanwhile, the annular groove 62 on the inner wall of the lid 6 is engaged with the annular protrusion 13 of the body 1, while the stopper portion 63 of the lid 6 holds the outer engagement member 2 and the inner engagement member 4 in place on the rim 110 of the body 1. When the neck 51 of the cutting member 5 is sleeved with the actuating member 7, the passage 710 of the actuating member 7 is air-tight engaged with the round protrusion 511 of the neck 51, allowing the outlet holes 512 of the neck 51 to be air-tight sealed by the cover portion 71 of the actuating member 7. In the meantime the annular protrusion 700 on the inner wall of the annular body 70 of the actuating member 7 abuts against the bottom of the annular groove 510 of the neck 51.

Figure 4:
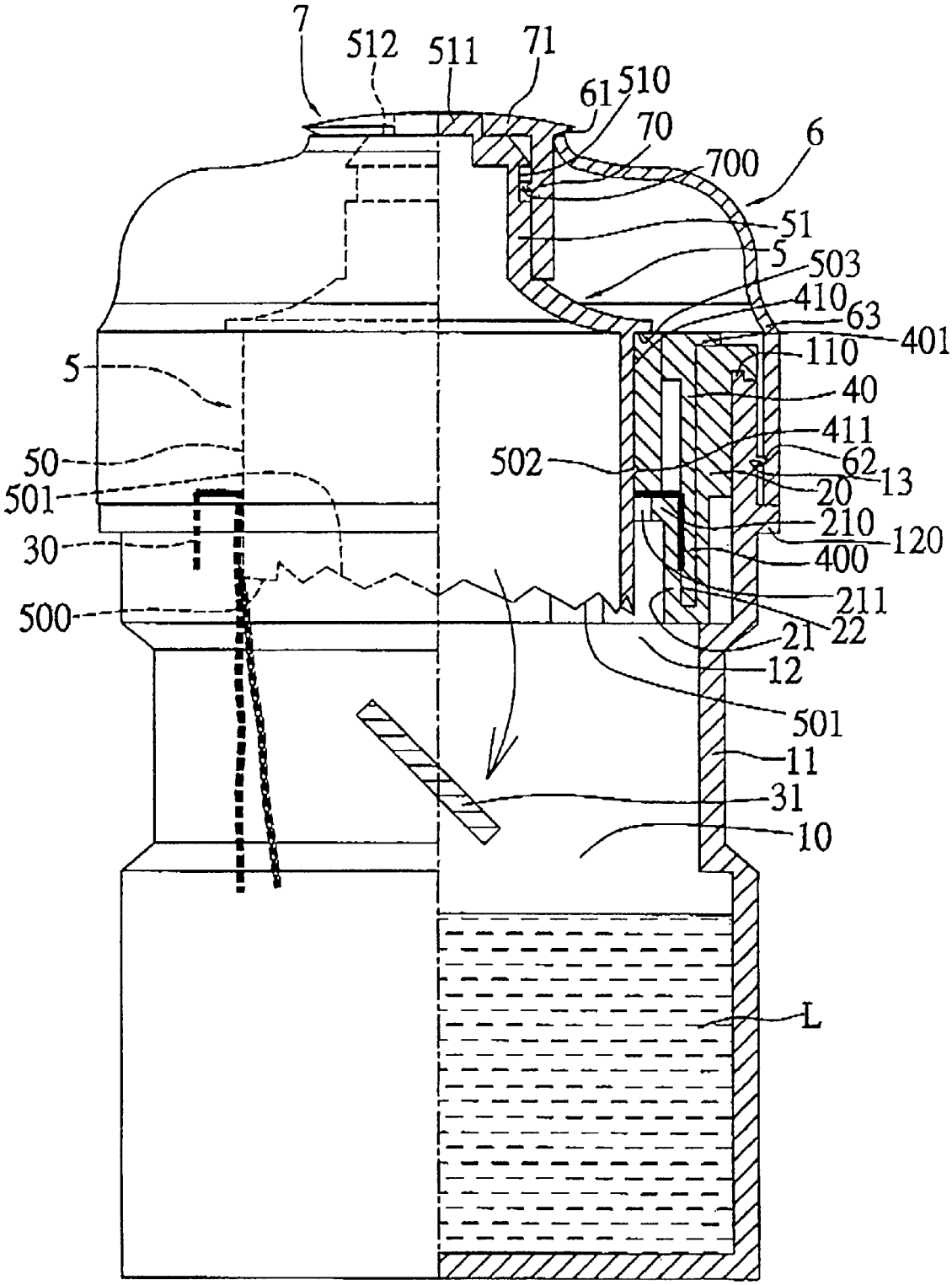
FIG. 4 is a schematic view of the container with separate storage spaces of the present invention, used to illustrate the cutting member together with the actuating member being pressed downwardly to cut open the sealing package.

To mix the formula 31 with the liquid solution 8, as shown in FIG. 4, a user simply has to press the actuating member 7 toward the sealing package 3, allowing the cutting member 5 to move downwardly from a first position where the cutting member 5 is in non-contact with the sealing package 3 to a second position where the sealing package 3 is cut open by the cutting member 5. When the cutting member 5 together with the actuating member 7 reach the second position, the annular protrusion 502 on the annular body 50 of the cutting member 5 is moved to be disengaged from the first position annular groove 410 and then to be engaged with the second portion annular groove 411 of the inner engagement member 4. In the meantime, the active portion 501 and the inactive portion 500 of the cutting member 5 will first press on the peripheral portion 30 of the sealing package 3 and then cut open the sealing package 3 by the active portion 501, allowing the formula 31 to drop via the opening 12 down to the liquid solution L out of the sealing package 3. In this operation, because a portion of the peripheral portion is protected by the inactive portion 500 of the cutting member 5 from being cut off by the active portion 501, the portion of the peripheral portion 30 corresponding to the inactive portion 500 is still attached to other part of the sealing package 3, thereby allowing the cut-open portion of the sealing package 3 to be prevented from falling into the liquid solution L.

Figure 5:
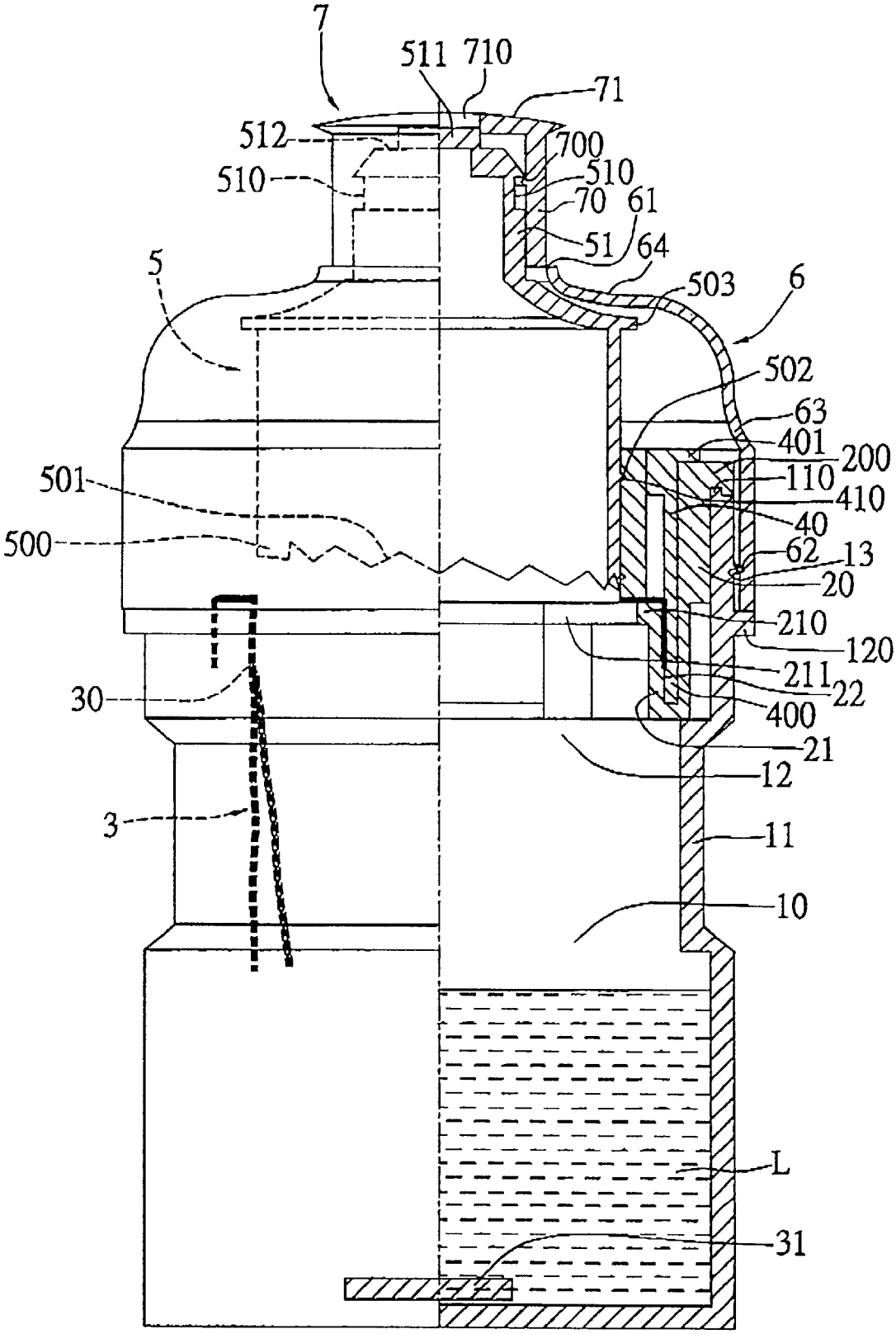
FIG. 5 is a schematic view of the container with separate storage spaces of the present invention, used to illustrate the actuating member being pulled upwardly.

As shown in FIG. 5, after the formula 31 falls into the liquid solution 8 pulling up the actuating member 7 will also upwardly move the cutting member 5 as the annular protrusion 700 is engaged with the annular groove 510 in the neck 51 of the cutting member 5. The upward-lift of the cutting member 5 stops when its shoulder 503 abut against the top 64 of the lid 6. At this point, continuing pulling the actuating member 7, the round protrusion 511 of the neck 51 will be disengaged from the passage 710 of the actuating member 7. The upward-pulling of the actuating member 7 will not stop until the annular protrusion 700 on the annular body 70 of the actuating member 7 is blocked by the top of the annular groove 510 of the neck 51 of the cutting member 5. Thereby, the opening 12 of the body 1, the through hole 211 of the outer engagement member 2, the through hole 42 of the inner engagement member 4, the outlet holes 512 of the cutting member 5 and the passage 710 of the actuating member 7 are all interconnected, allowing the liquid solution L mixed with the formula 31 to flow from the opening 12 of the body 1 to the passage 710 of the actuating member 7, for user consumption.

The invention has been described using exemplary preferred embodiments. However, it is to be understood that the scope of the invention is not limited to the disclosed embodiments. To the contrary, it is intended to cover various modifications and similar arrangements. The scope of the claims, therefore, should be accorded the broadest interpretation so as to encompass all such modifications and similar arrangements.

What is claimed is:

1. A container with separate storage spaces, comprising:

a body having a storage space defined by a body wall for forming the body for retaining a first substance therein and an opening for connecting the storage space;

an outer engagement member for being securely received in the opening of the body and formed with a through hole for connecting the opening of the body;

an inner engagement member for being securely engaged with the outer engagement member in a manner that a sealing package for hermetically enclosing a second substance to be mixed with the first substance in the storage space, is allowed to be interposed between the inner engagement member and the outer engagement member, so as to hermetically seal the through hole of the outer engagement member and a through hole formed in the inner engagement member in position corresponding to the through hole of the outer engagement member, thereby preventing the first substance from escaping from the opening of the body;

a cutting member slidably sleeved with the inner engagement member, allowing the cutting member to move relative to the inner engagement member from a first position where the cutting member is in non-contact with the sealing package, to a second position where the sealing package is cut open by the cutting member to release the second substance from the sealing package, thereby allowing the second substance to be mixed with the first substance via the opening of the body, wherein the cutting member is provided with at least an outlet for connecting the through hole of the inner engagement member; and a lid member attached to the body for covering the cutting member, the inner engagement member and the outer engagement member therein and formed with a retaining hole for slidably retaining an actuating member therein, wherein the actuating member being formed with a passage for interconnecting the atmosphere and the at least an outlet of the cutting member, and the actuating member being adapted to be coupled with the cutting member so as to allow the actuating member to be protruded from the retaining hole of the lid member, when the cutting member is in the first position, and allow the cutting member to be forced by the actuating member to the second position to thereby release the second substance from the sealing package, when the actuating member is pressed toward the sealing package by an external force.

2. The container with separate storage spaces of claim 1, wherein the second substance is enclosed in the sealing package made of an air-proof, water-proof flexible material.

3. The container with separate storage spaces of claim 2, wherein the air-proof, water-proof flexible material is aluminum foil.

4. The container with separate storage spaces of claim 1, wherein the sealing package is greater in size than the through holes of the inner and outer engagement members, so that the opening of the body can be hermetically sealed by a structure composed of the inner engagement member, the outer engagement member, and the sealing package interposed therebetween.

5. The container with separate storage spaces of claim 1, wherein the cutting member is formed with a protrusion arranged to be separably, air-tight engaged with the passage of the actuating member under the circumstance that the actuating member is coupled in position with the cutting member, allowing the outlet of the cutting member to be interconnected with the atmosphere via the passage of the actuating member under the circumstance that subsequent to the cut-open of the sealing package by the cutting member, the actuating member is driven by an external force to move toward a direction away from the sealing package to disengage the protrusion of the cutting member from the passage of the actuating member.

6. The container with separate storage spaces of claim 1, wherein the sealing package is disposed in the outer engagement member and then interposed between the inner and outer engagement member by securely engaging the inner engagement member with the outer engagement member.

7. The container with separate storage spaces of claim 1, wherein the cutting member is formed with a cutting end having an active portion for cutting open the sealing package and an inactive portion connected to the active portion for preventing the sealing member from being completely cut off.

8. The container with separate storage spaces of claim 7, wherein the active portion of the cutting member has a plurality of continuously-formed saw-like teeth.

9. The container with separate storage spaces of claim 7, wherein the inactive portion of the cutting member is flat in surface.

10. The container with separate storage spaces of claim 1, wherein the first substance is in a solid state.

11. The container with separate storage spaces of claim 1, wherein the first substance is in a liquid state.

12. The container with separate storage spaces of claim 1, wherein the first substance is in a gaseous state.

13. The container with separate storage spaces of claim 1, wherein the second substance is in a solid state.

14. The container with separate storage spaces of claim 1, wherein the second substance is in a liquid state.

15. The container with separate storage spaces of claim 1, wherein the second substance is in a gaseous state.

* * * * *